US007159382B2

(12) United States Patent
Schuller et al.

(10) Patent No.: US 7,159,382 B2
(45) Date of Patent: Jan. 9, 2007

(54) OPEN-END SPINNING MACHINE WITH A PLURALITY OF SPINNBOXES WITH RESPECTIVE ROTORS AND COVERS

(75) Inventors: Edmund Schuller, Ingolstadt (DE); Josef Schermer, Bergheim-Unterstall (DE); Johann Schmidt, Ingolstadt (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 11/245,457

(22) Filed: Oct. 6, 2005

(65) Prior Publication Data

US 2006/0137320 A1 Jun. 29, 2006

(30) Foreign Application Priority Data

Oct. 7, 2004 (DE) ..... 10 2004 049 129

(51) Int. Cl.
*D01H 4/08* (2006.01)

(52) U.S. Cl. ..... 57/406

(58) Field of Classification Search ..... 57/404–417
See application file for complete search history.

(56) References Cited

U.S. PATENT DOCUMENTS 3,595,002 A * 7/1971 Koritysky et al. ..... 57/406
4,278,259 A * 7/1981 Mitsuya et al. ..... 277/647
4,314,438 A * 2/1982 Miyamoto et al. ..... 57/406
5,636,505 A 6/1997 Havranek

FOREIGN PATENT DOCUMENTS

DE 4306272 9/1994
DE 2992039 5 U 1/2000

OTHER PUBLICATIONS

German Patent Office Search Report, Feb. 17, 2005.
EPO Search Report, Jan. 23, 2006.

* cited by examiner

*Primary Examiner*—Shaun R. Hurley
(74) *Attorney, Agent, or Firm*—Dority & Manning

(57) ABSTRACT

The invention relates to an open-end spinning machine with a plurality of spinnboxes and rotors (2) arranged in them, in which each spinnbox comprises, among other things, a cover (1) arranged on a front side of the particular associated rotor (2). At least one limitation device (7) for limiting the rotor movement in the direction of the longitudinal axis of the rotor onto the cover (1) is provided, which limitation device (7) covers a circular segment of a possible circular contact area between rotor (2) and cover (1).

24 Claims, 4 Drawing Sheets

OPEN-END SPINNING MACHINE WITH A PLURALITY OF SPINNBOXES WITH RESPECTIVE ROTORS AND COVERS

FIELD OF THE INVENTION

The present invention relates to an open-end spinning machine with a plurality of spinnboxes and rotors arranged in them, in which each spinnbox comprises, among other things, a cover arranged on a front side of the particular associated rotor. The invention also relates to covers for use on spinnboxes of open-end spinning machines.

BACKGROUND

During the operation of open-end spinning machines, it frequently occurs that very rapidly rotating rotors leave the position intended for them. Thus, it can occur that a rotor moves back and forth in the direction of the longitudinal axis of its rotor shaft. This can cause problems since the rotor arranged inside a spinnbox has as a rule little freedom of movement.

A section of the spinnbox regularly forms a cover that is movably arranged for opening the spinnbox. In the normal operating state, the rapidly rotating rotor is arranged only a few millimeters from the closed cover. If the previously described movements of the rotor occur in this state there is the danger that the rotor comes to rest with its annular front side on the cover of the spinnbox. Then, significant damage to the particular covers concerned can occur as a consequence of the high rotor speeds of approximately over 150,000 rpm. Furthermore, the rotor that makes contact also suffers and must, if necessary, be replaced after several such events. Both the replacing of a rotor as well as the replacing of a cover is associated with significant cost, which represents a significant disadvantage for the operation of spinning machines.

In order to solve this problem, e.g., DE 44 18 723 C1 teaches that an open-end rotor spinning apparatus can be designed with a spinning rotor comprising an open side limited by a rotor edge, with a housing receiving the spinning rotor and with a rotor cover covering the housing and the open rotor side in such a manner that the area of the rotor cover opposite the rotor edge is designed as a rotor contact surface designed as a wear surface or as a wear-resistant surface. The rotor contact surface suggested by the invention does effectively prevent the rotor from making unintended contact with the cover. However, it proved to be expensive to integrate a closed ring, like the one suggested by the invention, in a closed construction into the cover. This requires further interventions into the geometry of the structural components and results in addition in changes of the spinning behavior of the arrangement.

SUMMARY

The present invention therefore addresses the problem of creating an apparatus with which an undesired contact between rotor and cover is effectively prevented, that is especially simple to manufacture at the same time, and that has no or only very slight effects on the spinning behavior of the entire machine. Additional objects and advantages of the invention are set forth in part in the following description, or may be apparent from the description, or may be learned through practice of the invention.

In order to solve the previously cited problem, the initially cited open-end spinning machine is characterized in that at least one limitation device for limiting the rotor movement in the direction of the longitudinal axis of the rotor onto the cover is provided, which limitation device covers a circular segment of a possible circular contact area between rotor and cover. The extension of the limitation device of the invention is limited to a circular segment that is just large enough so that a reliable operating of the spinning machine is ensured. The arrangement areas are limited to an annular area whose center is congruent with the center of a yarn take-off opening also arranged on the cover. The necessity of making changes in the entire area of the rotating circle is eliminated by the limitation to a circular segment of this annulus. Instead, a limitation device that is just large enough as required can be arranged limited to an especially suitable segment of this annular area. In customary cover designs, the area of the yarn take-off opening is perforated by boreholes, conduits and openings, so that any particular desired arrangement of the limitation device is rendered difficult or is not even possible. This problem is solved by the present invention in that the arrangement of the limitation device is limited to the necessary segments.

An advantageous further development of the invention provides that at least one section of the limitation device is designed like a shaft or link [web] for fastening the limitation device to the cover. Thus, a shaft-like section can be fastened in an especially simple manner in a borehole in the cover. Another solution provides a link-shaped section in a groove formed in a complementary manner.

The present invention provides two other advantageous embodiments as a function of the application, in which it is provided that the material of the limitation device is harder than the material of the rotor, at least on the rotor side, or, alternatively, the material of the limitation device is softer than the material of the rotor, at least on the rotor side. If, e.g., very expensive and long-lasting rotors are used that are very easily damaged upon contact and become unusable, it is advantageous to use a limitation device consisting of a material softer than the rotor material. In case of a contact, the limitation device wears out first in this instance and the rotor remains completely undamaged. Such an arrangement requires a replacement of the limitation device from time to time if necessary. It can occur in another application that relatively economical rotors are used and that relatively long servicing intervals are desired. In this instance, the limitation device can consist of a material that is harder than the rotor material so that the limitation device achieves a very long service life.

It proved to be especially advantageous for the fastening of the limitation device to the cover if the limitation device is pressed in, screwed in or adhered in. In particular, pressing in and screwing in have already proven themselves in practice and ensure an especially reliable hold of the limitation device during operation.

It proved to be advantageous for an economical manufacture and a simple inclusion of the limitation device if it has one or more contact surfaces consisting of one of the materials steel, hard metal, especially sintered metal, ceramics or plastic, especially Teflon, at least on the rotor side. It can be selectively achieved by an appropriate selection of the materials that the contact surfaces achieve especially good sliding properties and an especially high resistance force. A limited use of such materials on certain sections such as, e.g., the contact surfaces brings it about that the remaining area of the limitation device can be manufactured, e.g., from a customary steel, that can then be readily pressed in, screwed in or adhered in.

In order to facilitate the operation and service of the open-end spinning machine designed in accordance with the invention, it is especially advantageous if it is equipped with a limitation device comprising a wear indicator. An operator or, given the appropriate design of the wear indicator, also a servicing device can rapidly detect the particular wear state of the limitation devices in an especially simple manner and with a high degree of reliability and initiate, if necessary, required servicing and/or replacement measures.

An embodiment of the invention that is especially easy to realize is to design the limitation device as a pin. The pin preferably has a diameter of 3–7 mm and is therefore capable of compensating fluctuations of tolerance in the position of the rotors and of limiting rotors with very different diameters in their movement. A pin can be pressed, e.g., from the front or the back into a borehole extending through the cover. This constitutes an especially simple method of manufacture. The pin is securely held relative to the designed contact surfaces with the cover due to the frictional forces. However, it is possible at the same time to repair a pin that is already worn out by pressing it out and replacing it with a new pin.

Another especially advantageous further development of the present invention provides positioning means that ensures the relative position between the limitation device and the cover. While special measures are required, e.g., when pressing a pin into a through borehole with a uniform diameter in order to ensure that the pin always has the correct interval to the rotor in the inserted state, the insertion of a pin can be clearly simplified by using the positioning means of the invention. To this end it is possible, for example, to add a through borehole with a smaller diameter into the cover and to add a coaxial borehole with a larger diameter into the cover from the cover side facing the rotor. The depth of the larger, coaxial borehole then sets the maximal pressing-in-depth of the limitation device or of the pin. In this instance, when the pin is being replaced, the old pin merely has to be removed and the new one simply pressed in up to the stop formed by the two coaxial boreholes.

In order to be able to operate a limitation device with as many rotor diameters as possible, it is advantageous if the contact surface of the limitation device facing the rotor projects in the radial direction of the cover over the at least one shaft or link section. Thus, it is, e.g., conceivable to use a pin-shaped lower section that is fastened to the cover in the previously described manner. A mushroom-shaped or disk-shaped contact surface consisting of the same or material or one of the previously cited materials can be arranged on this pin. The contact surface should cover as large a radial area as possible, in the radial direction of the cover and thus viewed also in the radial direction of the yarn take-off opening.

Finally, a replacement of the limitation device is especially simplified if it is connected to the cover by a snap connection. Given this design, the limitation device can be quite readily replaced manually or with a simple tool.

In addition, the present invention also relates to a cover for being used on spinnboxes of open-end spinning machines that is characterized in that the cover comprises fastening means for fastening to a spinnbox, and at least one limitation device for limiting the rotor motion in the direction of the longitudinal rotor axis toward the cover, which limitation device covers a circular segment of a possible circular contact area between rotor and cover. A cover designed in this manner can be used at different workstations or spinning positions or even in different spinning machines and can be replaced in a rapid and simple manner as required. This is all the more the case if fastening means such as screw connections, insertion connections or snap connections, that are especially easy to loosen, are used. The previously described advantages of the invention when it is used in a spinning machine analogously apply to the cover itself.

Other advantages of the invention result from described in connection with the following exemplary embodiments and the drawings.

DESCRIPTION

Figure 1:
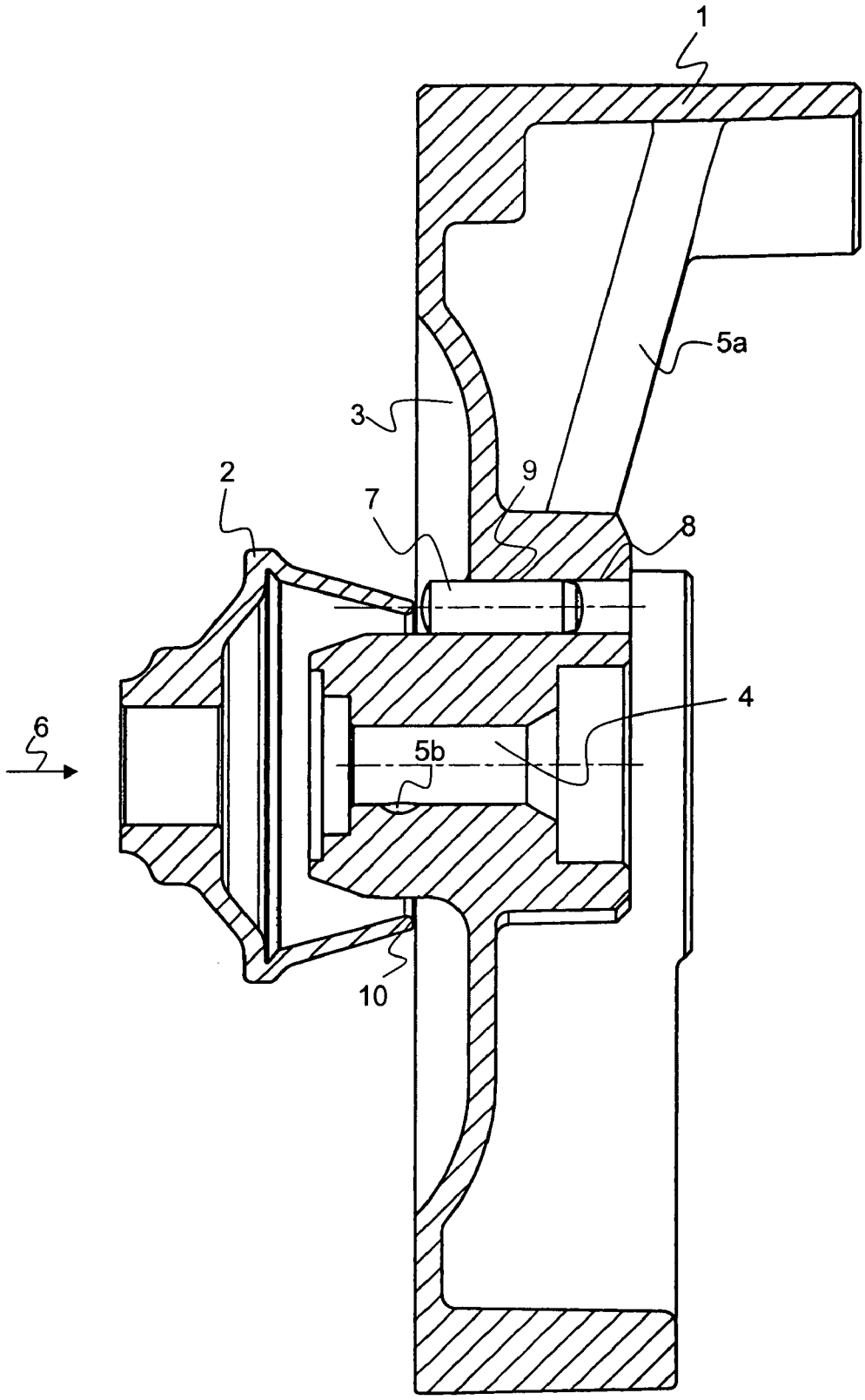
FIG. 1 shows an axial sectional view of a first embodiment in accordance with the invention.

Reference is now made to the embodiments of the invention, one or more examples of which are illustrated in the drawings. Each embodiment is provided by way of explanation of the invention, and is not meant as a limitation of the invention. For examples, features illustrated or described as part of one embodiment may be used with another embodiment to yield still a further embodiment.

FIG. 1 shows a cover 1 designed in accordance with the invention together with a rotor 2 in an axial sectional view. Rotor 2 shown on the left side is only shown by its head for the sake of better clarity since a representing of the shaft can be dispensed with for explaining the present invention. Rotor cover 1 is designed as a cast part designed on the rotor side with plate-shaped recess 3. Cover 1 forms a component of a spinning chamber that surrounds the rotor and is not shown in more detail. The representation shows cover 1 in a position closing the spinnbox. In order to open the spinnbox cover 1 is moved to the right as needed. Yarn take-off opening 4 is located in the middle of cover 1 through which opening the spun yarn is taken off during the running production. Several conduits and/or boreholes such as, e.g., air conduit 5*a* or threaded borehole 5*b*, which is only partially shown on account of the sectional view, run within cover 1. In order to effectively avoid a contact of cover 1 by moving rotor 2, that can occasionally move in the direction of arrow 6, the cover is provided with pin-shaped limitation device 7. Limitation device 7 is located in borehole 8, that exhibits a slight undersize relative to the pin diameter of limitation device 7. Limitation device 7 is positioned and fastened at the same time by pressing it into represented borehole 8. The required hold is generated in normal directions in the form of frictional forces on designed contact area 9 by the forces acting on account of the pressing onto limitation device 7. Limitation device 7 is positioned in this case in such a manner that it has a certain set interval from a front side 10 of rotor 2 facing cover 1.

The pin of limitation device 7 shown can, if it is worn, be pressed out and readily replaced by pressing in a new pin. The material of the entire pin of limitation device 7 or only of the section facing rotor 2 can selectively consist of a material that wears more rapidly or less rapidly than the material of rotor 2. This can be made as a function of the particular properties required. Thus, e.g., when an especially soft and rapidly-wearing material is used for the pin of fastening device 7, an especially high service life of rotor 2 is achieved and vice versa.

Figure 2:
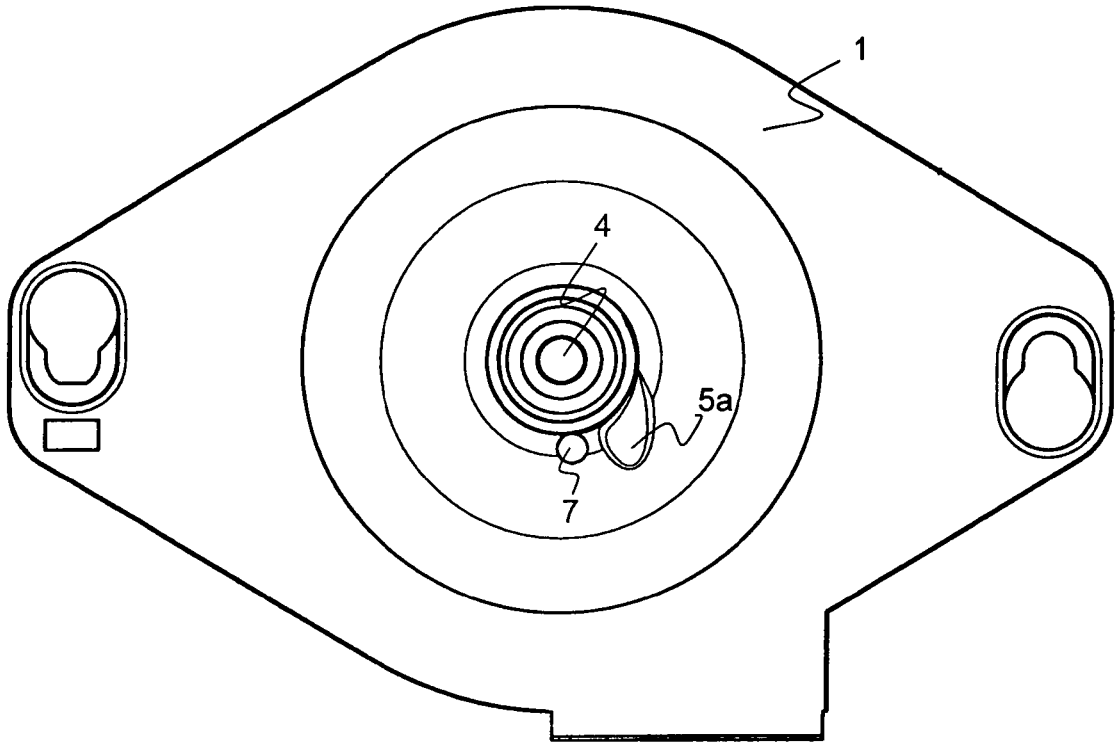
FIG. 2 shows a front view of a cover in accordance with the invention.

FIG. 2 shows cover 1 in accordance with the invention from FIG. 1 again in a front view. Yarn take-off opening 4 is located in the middle and under it the pin of limitation device 7. It can be clearly recognized in this view that air conduit 5*a* results in an impressing on plate-shaped recess 3 of cover 1. This area of air conduit 5*a* in particular should be protected from being contacted by rapidly-rotating rotor 2. For this reason limitation device 7 is arranged directly adjacent to it. The advantage of the present invention consisting in the fact that the extension of limitation device 7 only covers an annual segment of a possible annular contact area surrounding yarn take-off opening 4 can also be clearly recognized in this view. In this embodiment there would be insufficient space for arranging a limitation device 7 at the site of air conduit 5*a*. In addition, the arrangement of the pin of limitation device 7 has no noticeable effect or no effect at all on the spinning behavior of cover 1 of the invention on account of its small dimensions.

Figure 3:
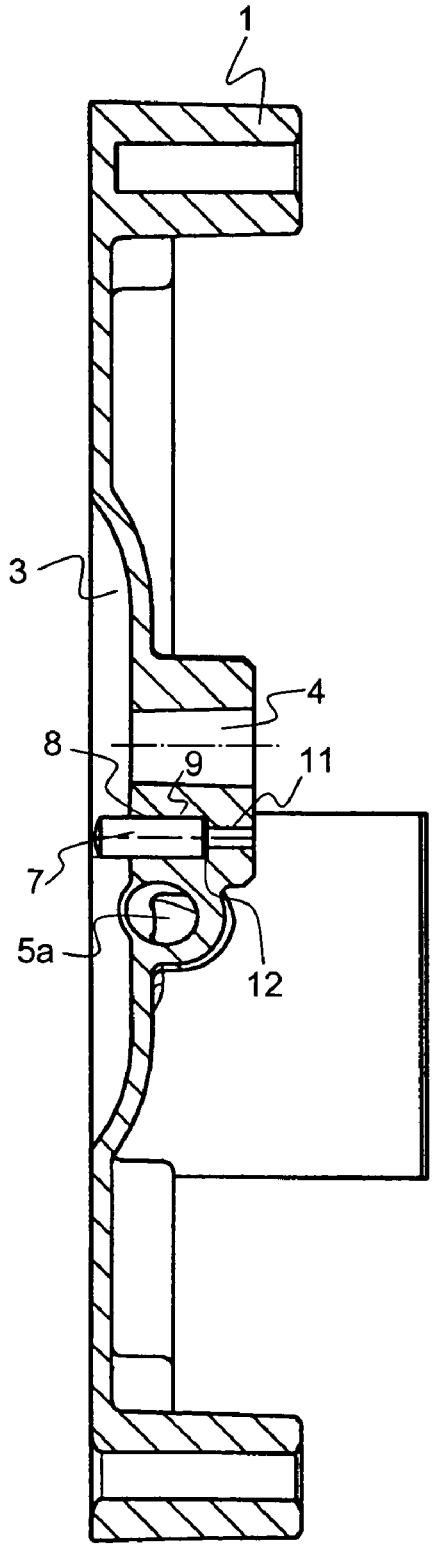
FIG. 3 shows an axial sectional view of a second embodiment in accordance with the invention.

FIG. 3 shows another embodiment of a cover 1 in accordance with the invention. Even this cover 1 comprises a plate-shaped recess 3 and a yarn take-off opening 4. Limitation device 7, that is again designed as a pin, is arranged adjacent to, that is, in the present drawing below yarn take-off opening 4. In order to receive limitation device 7, cover 1 is provided with a larger borehole 8 and a smaller borehole 11. Both boreholes are situated coaxially relative to one another and have positioning means 12 in the form of a shoulder. Larger borehole 8 is placed on the side of cover 1 facing rotor 2. The pin pressed in as limitation device 7 can be pressed in only up to the stop onto positioning means 12 in borehole 8. It can therefore be ensured in a simple manner by setting the bore depth of borehole 8 that the bottom of limitation device 7 is always pressed in up to a defined point and is therewith correctly positioned relative to cover 1. However, it can also be alternatively provided in addition to the pressings in of pins shown in the figures for fastening limitation device 7 in cover 1 that other fastening means are used, such as, e.g., the screwing in or the adhering in of pins. Even in this case a fastening takes place via the contact areas of limitation device 7 to cover 1.

Figure 4:
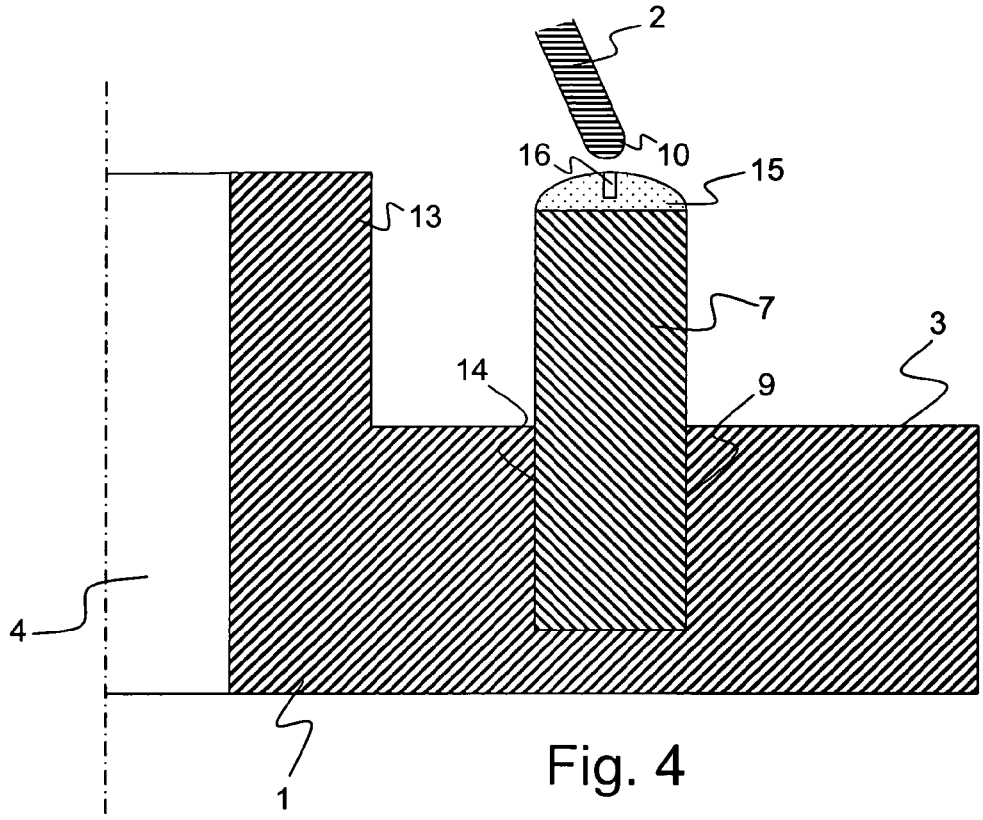
FIG. 4 shows a partial sectional view of a cover with a limitation device in accordance with the invention.

FIG. 4 shows a partial area of a cover 1 in accordance with an embodiment of the invention in an enlarged sectional view. Yarn take-off opening 4 is located on the left side, the length of which opening is determined by the material thickness of cover 1 as well as the height of collar 13 surrounding yarn take-off opening 4. Limitation device 7 is shown pressed into sunk borehole 14 directly adjacent to collar 13. A section of rotor 2 with the front side of rotor 2 can be recognized on the top of limitation device 7. A set interval is adjusted with great accuracy between front side 10 and head 15 of limitation device 7. In the embodiment shown head 15 of limitation device 7 consists of a different material than the remaining section of limitation device 7. In this instance head 15 is manufactured from a relatively softer plastic that wears down distinctly more rapidly relative to the material of rotor 2, thus protecting front side 10 of rotor 2 in case of a contact. Wear indicator 16 is also arranged on head 15 of limitation device 7. Wear indicator 16 serves to monitor the wear of head 15 due to contacts with rotor 2. Wear indicator 16 is designed here as a groove-shaped or bore-shaped recess that can be readily recognized as a recess in the new or partially worn state. If head 15 wears down so much that it is nearly used up, the wear indicator formed as a recess completely disappears and thus furnishes information about the wear status. The type of wear indicator shown represents an especially simple and favorable embodiment. However, it is also additionally conceivable to arrange material with, e.g., different colors in layers over each other so that a statement can be gathered about the wear status of limitation device 7 and of head 15 using the colors that become visible.

Figure 5:
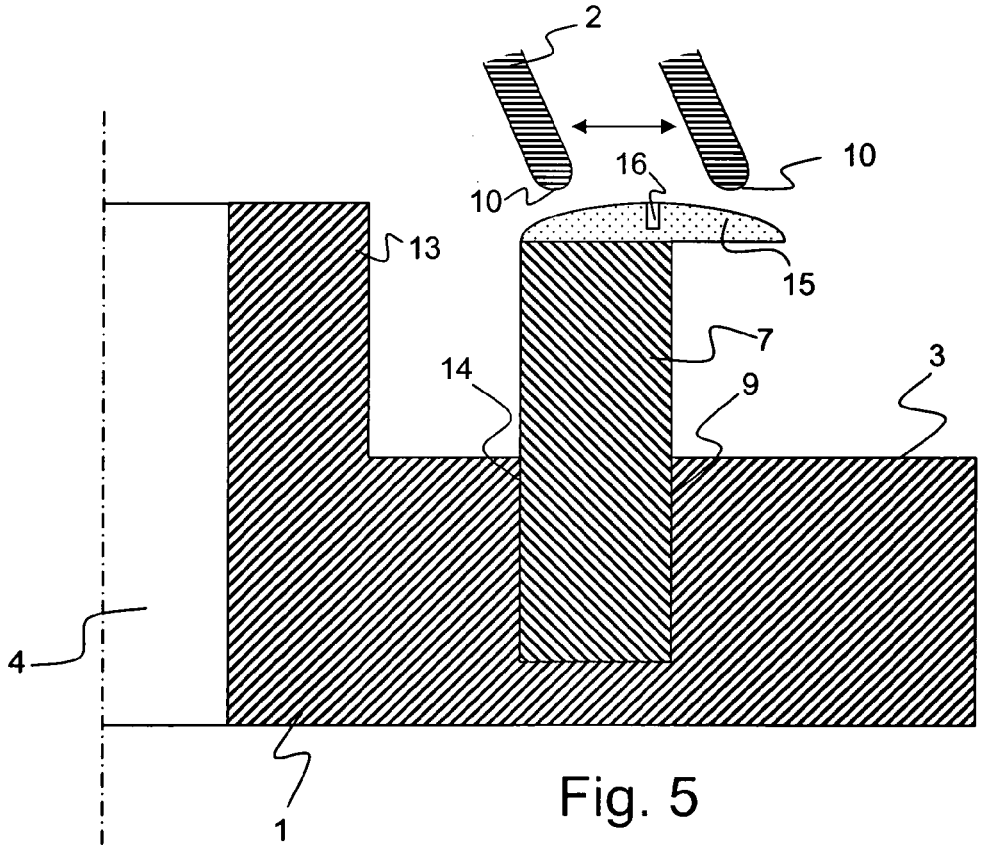
FIG. 5 shows a partial sectional view of a cover with another limitation device in accordance with the invention.

Finally, FIG. 5 shows a cover 1 in partial section that largely corresponds to cover 1 shown in FIG. 4. In distinction to limitation device 7 shown in FIG. 4, the limitation device 7 shown in this view comprises radially outwardly prolonged head 15 on the top of limitation device 7. For the rest, head 15 is again provided with a wear indicator 16. The advantage of the radially prolonged covering by head 15 in practical use is that even rotors 2 with greatly differing rotor diameters can be used with one and the same limitation device 7. The different rotor diameters that can be used are indicated with the two rotor sections shown.

For the rest, the present invention is not limited to the exemplary embodiments shown but rather numerous modifications of the invention are possible within the scope of the claims. Thus, an expert in the art can manufacture head 15 from a plurality of known materials such as, e.g., even from wood as an especially economical wear material. Furthermore, in addition to the cited fastening means even numerous other fastening means known to the expert in the art can be used in combination with the present invention.

The invention claimed is:

1. An open-end spinning machine with a plurality of spinnboxes, each said spinnbox having a rotor disposed therein and a cover arranged at a front open side of said rotor, and further comprising a limitation device attached to said cover at a location so as to limit axial movement of said rotor onto said cover, said limitation device having a size and contact surface that is less than a full possible circular contact area between said rotor and said cover such that upon axial movement of said rotor towards said cover, said limitation device contacts said rotor over a limited circumferential segment of the possible circular contact area.

2. The spinning machine as in claim 1, wherein said limitation device comprises an axially extending shaft member that is fitted into said cover for attaching said limitation device to said cover.

3. The spinning machine as in claim 1, wherein said contact surface is formed of a material that is harder than contacting material of said rotor.

4. The spinning machine as in claim 1, wherein said contact surface is formed of a material that is softer than contacting material of said rotor.

5. The spinning machine as in claim 1, wherein said limitation device is attached to said cover by one of a press-fit, screw connection, snap connection, or adhesive.

6. The spinning machine as in claim 1, wherein said contact surface is formed of one of the materials of steel, sintered metal, ceramic, or plastics.

7. The spinning machine as in claim 1, wherein said limitation device further comprises a wear indicator configured in said contact surface.

8. The spinning machine as in claim 1, wherein said limitation device comprises a pin configuration having a head that defines said contact surface and a shaft that is pressed into said cover.

9. The spinning machine as in claim 8, wherein said head comprises a diameter of between about 3 mm to about 7 mm.

10. The spinning machine as in claim 1, further comprising a positioning stop member defined between said cover and said limitation device that ensures a desired relative position of said limitation device.

11. The spinning machine as in claim 1, wherein said limitation device comprises an axially extending shaft member that is fitted into said cover and a head that defines said contact surface, said head comprising a radius that is greater than said shaft so as to extend radially beyond said shaft.

12. The spinning machine as in claim 11, wherein said head is radially offset relative to said shaft.

13. A cover for use in spinnboxes of an open-end spinning machine to cover the open front of a rotor disposed within the spinnbox, said cover comprising a limitation device attached to said cover at a location so as to limit axial movement of the rotor onto said cover, said limitation device having a size and contact surface that is less than a full possible circular contact area between the rotor and said cover such that upon axial movement of the rotor towards said cover, said limitation device contacts the rotor over a limited circumferential segment of the possible circular contact area.

14. The cover as in claim 13, wherein said limitation device comprises an axially extending shaft member that is fitted into said cover for attaching said limitation device to said cover.

15. The cover as in claim 13, wherein said contact surface is formed of a material that is harder than contacting material of the rotor.

16. The cover as in claim 13, wherein said contact surface is formed of a material that is softer than contacting material of said rotor.

17. The cover as in claim 13, wherein said limitation device is attached to said cover by one of a press-fit, screw connection, snap connection, or adhesive.

18. The cover as in claim 13, wherein said contact surface is formed of one of the materials of steel, sintered metal, ceramic, or plastics.

19. The cover as in claim 13, wherein said limitation device further comprises a wear indicator configured in said contact surface.

20. The cover as in claim 13, wherein said limitation device comprises a pin configuration having a head that defines said contact surface and a shaft that is pressed into said cover.

21. The cover as in claim 20, wherein said head comprises a diameter of between about 3 mm to about 7 mm.

22. The cover as in claim 13, further comprising a positioning stop member defined between said cover and said limitation device that ensures a desired relative position of said limitation device.

23. The cover as in claim 13, wherein said limitation device comprises an axially extending shaft member that is fitted into said cover and a head that defines said contact surface, said head comprising a radius that is greater than said shaft so as to extend radially beyond said shaft.

24. The cover as in claim 23, wherein said head is radially offset relative to said shaft.

* * * * *